United States Patent [19]

Braddy et al.

[11] Patent Number: 4,761,116

[45] Date of Patent: Aug. 2, 1988

[54] TURBINE BLADE WITH TIP VENT

[75] Inventors: Bruce T. Braddy, Burlington; Sacheveral Q. Eldrid, Stoneham, both of Mass.

[73] Assignee: General Electric Company, Lynn, Mass.

[21] Appl. No.: 48,700

[22] Filed: May 11, 1987

[51] Int. Cl.[4] ..... F01D 5/18

[52] U.S. Cl. ..... 416/92; 416/97 R; 415/172 A

[58] Field of Search ..... 416/92, 97 R, 97 A; 415/172 A

[56] References Cited

U.S. PATENT DOCUMENTS

| | | | |
|---|---|---|---|
| 3,533,712 | 10/1970 | Kercher | 416/92 |
| 3,628,885 | 12/1971 | Sidenstick et al. | 416/92 |
| 3,635,585 | 1/1972 | Metzler | 416/92 X |
| 3,876,330 | 4/1975 | Pearson et al. | 416/92 |
| 3,885,886 | 5/1975 | Richter | 416/92 X |
| 3,982,851 | 9/1976 | Andersen et al. | 416/92 |
| 4,142,824 | 3/1979 | Andersen | 415/115 |
| 4,247,254 | 1/1981 | Zelahy | 416/97 R |
| 4,390,320 | 6/1983 | Eiswerth | 416/97 R |
| 4,411,597 | 10/1983 | Koffel | 416/92 |
| 4,424,001 | 1/1984 | North et al. | 416/92 |
| 4,606,701 | 8/1986 | McClay et al. | 416/92 |

FOREIGN PATENT DOCUMENTS

| | | | |
|---|---|---|---|
| 2843326 | 4/1979 | Fed. Rep. of Germany | 416/92 |
| 1426049 | 2/1976 | United Kingdom | 416/97 R |

*Primary Examiner*—Everett A. Powell, Jr.

*Attorney, Agent, or Firm*—Francis L. Conte; Derek P. Lawrence

[57] ABSTRACT

In a turbomachine having stationary and rotating bladed stages, the blades of the rotating bladed stage are cooled by ducting cooling fluid into an interior cavity formed in each blade. Each rotating blade has a tip portion which is closely adjacent an annular shroud to avoid hot gas products bypassing the blades. The required close clearance between the blade tips and the annular shroud has caused manufacturers to provide a recessed blade tip cap and an open plenum at the blade tip to improve cooling flow. This invention minimizes the height requirements of sidewalls to the open plenum by providing an opening in the blade sidewalls whereby cooling air can be discharged from the interior blade cavity and the blade plenum without regard to the clearance between the blade tip and the annular shroud.

3 Claims, 2 Drawing Sheets

TURBINE BLADE WITH TIP VENT

This invention was made with Government support under Contract DAAJ09-85-C-A481 awarded by the Department of the Army. The Government has certain rights in this invention.

BACKGROUND OF THE INVENTION

This invention relates, in general, to blades for a turbomachine such as a gas turbine; and, in particular, to cooling such blades at their tip portions.

A turbomachine such as a gas turbine, includes a turbine having a hot gas path comprising alternate annular stages of stationary nozzles and rotating blades. The blades are affixed to a disk which is, in turn, fixed to a rotor so that as hot gas flows in a generally axial direction through the hot gas path it will cause the transfer of kinetic energy to the blades and disk, thereby causing the rotor to be turned. The hot gas is released from an upstream combustion reaction and may have a temperature on the order of 2000 degrees Fahrenheit or higher. These elevated temperatures are typically accommodated by the cooling of stationary and rotating components in the hot gas path.

One method of cooling rotating turbine blades is to duct compressor discharge air axially along the gas turbine rotor until it can be picked up by the rotating blade to be cooled. The blade is formed with an interior cavity so that the cooling air is sent radially through the blade and then is discharged from the blade into the hot gas path through blade surface holes. The hot gas path includes an annular, radially outward shroud which extends axially and surrounds a rotating bladed stage so that the radial clearance between the shroud and the blade tips is as small as possible so as to minimize axial leakage of hot gas therebetween. If gas is permitted to bypass a bladed stage, it adversely impacts on turbine efficiency. Of course, the aforesaid radial clearance is also adjusted for avoiding the blade tips rubbing against the outer shroud.

Some blade tips are formed by joining radially extending sidewalls and radial holes are drilled through the tip into the interior cavity to allow cooling air to be removed from the interior cavity. However, some blades are not thick enough at their tips to permit such drilling; and if such blades were thick enough then it might be expected that an accidental rub between the blade and the shroud could cause undesirable effects upon the shroud. Even more significant, the use of a small radial clearance between the shroud and the blade tip could cause such radial drilled holes to be impeded from achieving a sufficient flow volume of discharged cooling air; or conversely, a larger radial clearance sufficient to permit adequate discharge of cooling air flow would result in unacceptable hot gas losses therethrough.

One solution to the radial tip clearance dilemma, is found in the discovery of a blade tip cap which is recessed from the tip of the blade to create and define an open plenum at the blade tip. The plenum is further defined by extensions of the opposite blade sidewalls. Cooling air, exhausted from the blade interior cavity, is fed into the plenum through at least one hole which connects the blade interior cavity with the plenum. The depth of the plenum; or conversely, the height of the sidewall extensions is dependent upon the cooling requirements. For example, the more cooling air to be removed from the blade interior cavity, the deeper the plenum or conversely the higher the plenum walls. However, as the height of the plenum walls is increased it becomes more difficult to cool because tip areas are further removed from cooled blade portions thereby increasing the length of the conduction path. This problem is especially acute at the leading edge of the turbine blade.

This problem was recognized in U.S. Pat. No. 4,142,824, issued to inventor Richard H. Andersen issued Mar. 6, 1979 and assigned to the assignee of the present invention. This patent is incorporated herein by reference. The patent teaches that certain external surfaces of the turbine blade may be cooled through conduction by means of passageways either drilled within the blade or formed by means of sleeves fastened to the outer circumference of the blades. This solution to the problem adds to the cost of manufacture while also being limited to situations where the blade design allows the drilling of interior passages or the application of cooling sleeves.

It is therefore an object of the present invention to provide an improved blade design having improved blade tip cooling.

It is another object of the invention to provide a blade tip design which will minimize the required height of sidewall extensions.

It is yet another object of the invention to provide a blade tip design which will accommodate blade tip cooling requirements independent of radial clearance requirements with respect to the surrounding shroud.

SUMMARY OF THE INVENTION

A turbomachine blade includes opposite and radially extending sidewalls defining convex (suction) and concave (pressure) surfaces disposable in the hot gas path of a turbomachine. A blade tip cap is disposed radially inwardly from the blade tip to define an interior cavity within the blade and an open plenum recessed from the tip of the blade. The plenum is further defined by convex and concave sidewall extensions from the blade tip cap. The interior of the blade is fluid cooled and there is at least one hole interconnecting the plenum with the blade interior cavity. The blade tip is further formed with an opening in the sidewall extension for improving the flow of cooling air from the blade interior cavity to the blade tip plenum and out therefrom.

BRIEF DESCRIPTION OF THE INVENTION

The novel features believed characteristic of the invention are set forth in the appended claims. The invention, itself, together with further objects and advantages thereof is more particularly described in the following detailed description taken in conjunction with the accompanying drawings in which:

DETAILED DESCRIPTION OF THE INVENTION

Figure 1:
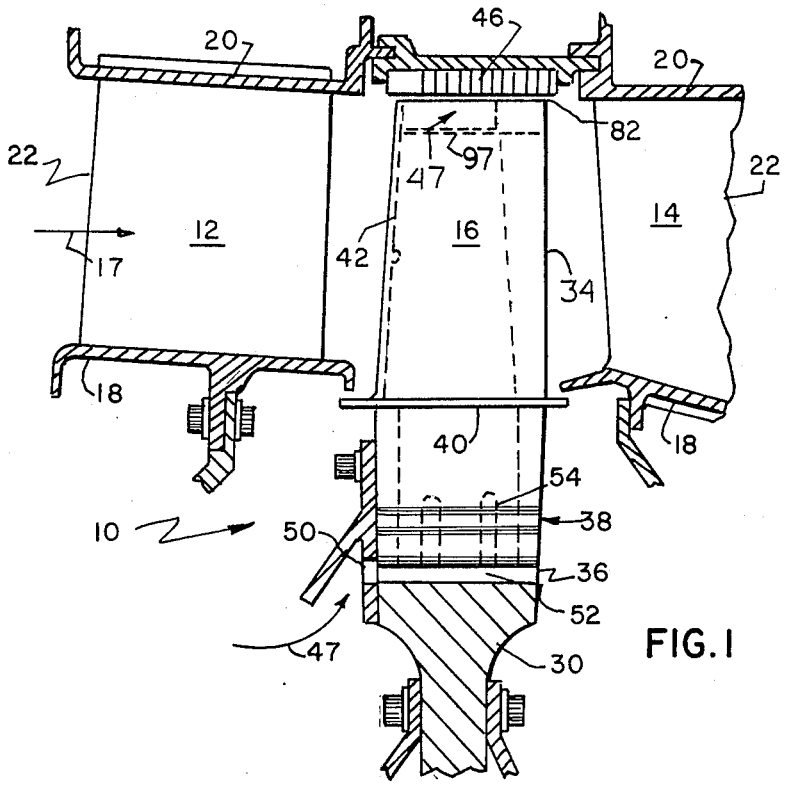
FIG. 1 is an elevation side view of a portion of the hot gas path of an axial flow turbomachine.

FIG. 1 represents a portion of a hot gas path in a turbine 10 of a gas turbine engine. Included in this representation are a stationary upstream stator stage 12, a downstream stationary stator stage 14 with a bladed rotor stage 16 therebetween. Upstream and downstream is taken with reference to the flow of hot gas through the turbine 10 as represented by the arrows 17. The hot gas 17, of course, is produced in a conventional combustor (not shown) upstream from the turbine 10. Each stator stage includes a radially inner support ring 18 and a radially outer support ring 20 with a plurality of airfoil vanes 22 (only one shown for each stage) therebetween so as to give a generally annular configuration to each stator stage.

The rotor stage 16 includes a disk 30 which is rotatable with and attached to a turbine rotor (not shown). A plurality of turbine blades 34 (only one shown) are attached to the disk 30 at a dovetail joint 36 between the disk 30 and a turbine blade root 38. A platform 40 connects the root 38 with a hollow airfoil portion 42 of the blade 34. When a plurality of blades 34 are assembled on the disk 30, the plurality of blade platforms 40 cooperate with adjacent upstream and downstream stator rings 18 to form a radially inner boundary of the hot gas path. A radially outer boundary of the hot gas path 17 stage is defined by a stationary outer shroud 46 which is connected between the adjacent stator stages 12 and 14.

Blade cooling is achieved by admitting a cooling fluid 47 into each blade root 38 through an inlet opening 50 in the blade root. The cooling fluid 47 may be compressor discharge air which is routed to the rotor stage 16 by any one of a number of known methods. The cooling fluid 47 is then channeled from the blade root 38 into the airfoil portion 42 in a manner to be more fully described. One means for admitting cooling fluid 47 into a blade interior cavity 43 includes inlet opening 50, an axial passageway 52 and channels 54 in the blade root 38.

Figure 3:
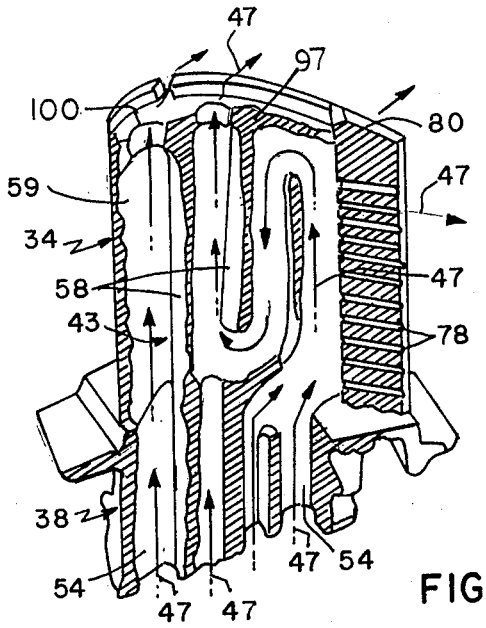
FIG. 3 is a cutaway view of a turbomachine blade in accordance with one embodiment of the present invention.

Referring to FIG. 3, the inlet opening 50 (FIG. 1) in the blade root 38 feeds a plurality of channels 54 in the root portion 38 of the blade 34. The channels 54 communicate with the interior cavity 43 in the airfoil portion 38 of the blade 16 which may include a plurality of baffles 58 for directing the cooling fluid 47 as needed throughout the blade interior cavity 43.

Figure 2:
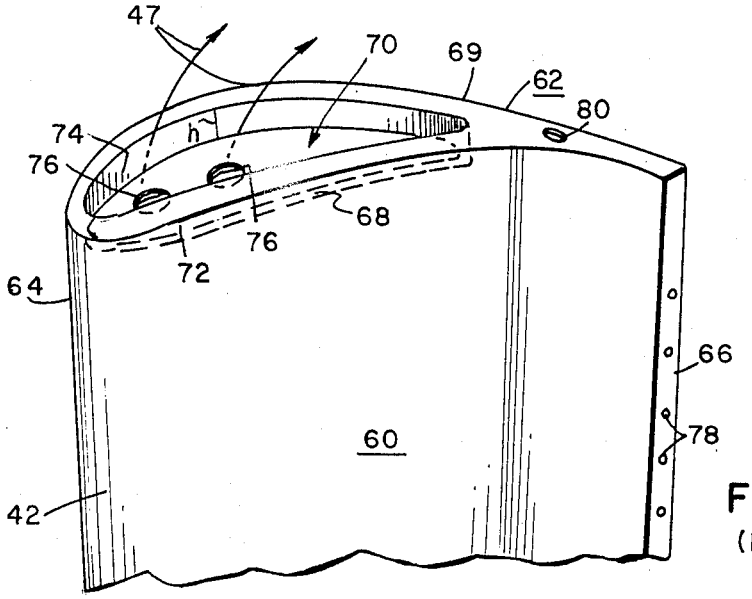
FIG. 2 (PRIOR ART)
FIG. 2 is a perspective view of a turbomachine blade having a tip portion in accordance with the prior art.

In accordance with FIG. 2, the airfoil portion 42 of the blade 34 includes a pair of substantially parallel radially extending sidewalls comprising a concave or pressure sidewall 60 of the blade and a convex or suction sidewall 62 of the blade. The sidewalls 60, 62 are connected to each other at a leading edge 64 and a trailing edge 66 of the airfoil. FIG. 2 shows the blade 34 with a prior art tip cap 68 which is recessed from the radially outer tip 69 of the blade to define an open plenum 70. Also defining the open plenum 70 are radial extensions of the sidewalls 60, 62 comprising a concave sidewall extension 72 and a convex sidewall extension 74. From FIG. 2, it can readily be seen that the blade 34 has two principal exhaust openings for the cooling fluid 47 including at least one hole 76 formed through the blade tip cap 68 (two are shown) and a plurality of trailing edge holes 78. In addition, there may be an additional hole 80 formed through blade tip 69 for conduction cooling of that area of the blade 34.

Referring now to FIG. 2 which shows a conventional blade tip of the prior art, the flow arrows 47 illustrate the flow of cooling air from the openings 76 in the blade tip cap 68, into the plenum 70 and over the convex wall extension 74. The flow is partially controlled by the radial clearance 82 between the tip of the blade 34 and the annular shroud 46, (FIG. 1), closely adjacent the blade tip. The clearance is a compromise between the blade cooling requirements; the openness between the blade tip and the shroud to allow the exiting of the cooling fluid; and, the requirement to minimize hot gas leakage bypassing the blade; hence the closeness between the blade tip and the shroud. It has been discovered that as the radial height of the blade sidewalls increases cooling of certain blade parts decreases. Thus as the radial height h of the plenum walls is increased to provide more effective cooling in the blade by improving the flow out of the blade through holes 76 into plenum 70, parts of the airfoil or blade removed from the hollow airfoil portion 42 may begin to develop cooling deficiencies because of the increased length in the conduction cooling path from the blade to the cooled blade hollow interior cavity. This problem has been well documented in U.S. Pat. No. 4,142,824, previously cited, wherein conduction cooling of the leading edge of the extended sidewalls by means of cooling holes or cooling sleeves is taught. In accordance with the present invention a solution to this problem has been devised which is cost effective and otherwise more efficient.

Figure 4:
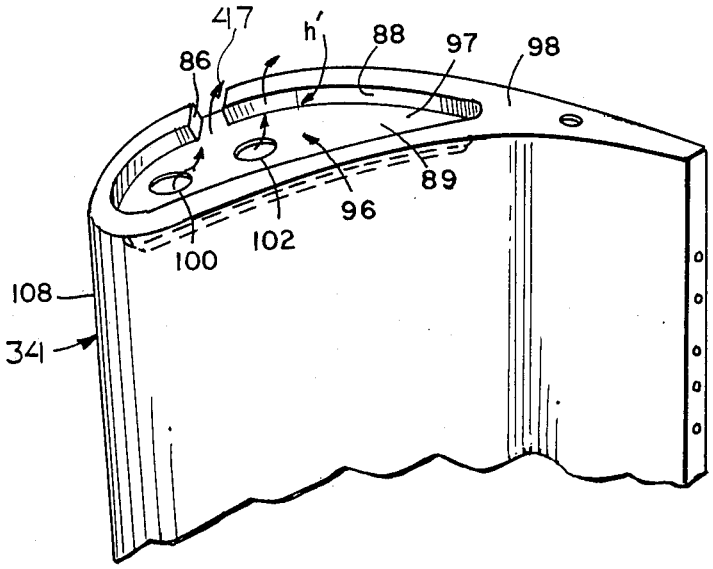
FIG. 4 is an enlarged perspective view of the tip of a turbomachine blade in accordance with the present invention.

Referring to FIG. 4 which shows the improved blade tip, the solution to the foregoing discussion of blade tip clearance and the cooling of blade parts removed from the hollow airfoil portion has been found to be an opening 86 in a convex or suction sidewall extension 88 of the blade 34 which allows cooling fluid in a plenum 96 formed by tip cap 97 to flow out of the plenum 96 without regard to the radial clearance between a tip 98 of the blade and the annular shroud 46 which surrounds the blade tips 98. The opening 86 is formed through the suction sidewall extension 88 to minimize the chance of hot gas entering the blade tip plenum 96. In a preferred embodiment shown in FIG. 4, wherein the blade tip cap includes a first hole 100 (leading edge) and a second hole 102 in the blade tip cap, it is preferred to place the opening 86 between the first hole 100 closest the leading edge 108 and any second holes 102 following so that the coolant flow out of the first hole 100 is directly flowed out of the opening 86 and is not diverted or otherwise interfered with by cooling airflow from any subsequent holes 102 in the blade tip cap. The reason for two holes in the tip cap 97 is so that the leading edge 108 of the blade may have a dedicated flow channel 59 in the blade interior cavity 43 (see FIG. 3) for improved cooling of the blade leading edge 108. Of course, it is possible to have more than one opening 86 in cooperation with more than one opening in the blade tip cap without departing from the true spirit and scope of this invention.

From the foregoing it can be seen that there are several advantages inherent in the present invention. The thermal performance of the turbine itself is improved due to the allowability of smaller tip clearances which minimizes axial leakage of hot gas flow. The opening 86 in the sidewall extension 88 means that blade cooling flow is no longer solely dependent on blade tip radial clearance. The relatively shallow plenum 96 with height h' less than h will permit better cooling of the blade tip sidewall extension 88 particularly in the leading edge and therefore obviate the need for other cooling passages or cooling sleeves. This is because the length of the conduction cooling path between the blade tip 98 and the cooled hollow airfoil portion is decreased. By locating the opening 86 on the suction side of the blade the chance for leakage into the blade plenum from outside the blade is minimized. Also, by locating the opening 86 close to the blade tip cap hole 100 closest to the leading edge, the cooling air flow exiting the blade interior cavity will be directly discharged from the plenum through the opening 86 without being diverted by cooling air flows from other holes 102 formed in the tip cap 97. With the inclusion of the opening 86 in the sidewall 88 the height h' of the plenum will be less than the height h of the prior art and thereby obviate hot spots in the plenum sidewalls.

While there has been shown what is considered to be a preferred embodiment of the invention, other modifications may occur to those having skill in the art. It is intended to claim, in the appended claims, all such modifications as would fall within the true spirit and scope of the claims.

What is claimed is:

1. An improved turbomachine blade having spaced apart, radially extending convex and concave sidewalls connected at leading and trailing edges; a blade tip cap recessed from the radially outer end of the blade; an interior cavity within the blade; an open plenum defined by the blade tip cap and radially extending sidewalls; at least first and second holes through the blade tip cap connecting the blade interior cavity with the open plenum, said first hole being closely adjacent the leading edge of the blade and the second hole being the next following hole and wherein the improvement comprises:

an opening in the radial convex sidewall, the opening being positioned between the first and second holes.

2. A turbomachine blade having spaced apart, radially extending convex and concave sidewalls connected at leading and trailing edges; a blade tip cap spaced radially inwardly from a radially outer end of the blade to define an interior cavity within the blade and an open plenum between the blade tip cap and the outer end of the blade; the open plenum defined in part by radial extensions of the convex and concave sidewalls; means for admitting cooling fluid to the interior cavity of the blade; at least one hole through the blade tip cap for communicating the interior cavity with the open plenum; and an opening formed through the radial extension convex sidewall closely adjacent the hole closest to the blade leading edge whereby cooling fluid from the interior cavity, in proximity to the blade leading edge, flows through the hole in the blade tip cap closest to the blade leading edge and out the opening in the radial extension convex sidewall.

3. In a gas turbine of the type having a hot gas path including at least one upstream stationary stator stage, at least one downstream stationary stage and a rotating bladed stage therebetween; the bladed stage surrounded by an annular shroud; the bladed stage including a plurality of fluid cooled blades each comprising convex and concave airfoil surfaces connected at leading and trailing edges; each blade further including a blade tip cap recessed from the radially outer end of the blade to define an interior cavity within the blade and an open plenum between the blade tip cap and the radially outer end of the blade; means for admitting cooling fluid into the blade interior cavity; at least one hole formed through the blade tip cap for communicating the interior cavity with the open plenum; and an opening in the convex surface between the blade tip cap and the radially outer end of the blade closely adjacent the hole in the blade tip cap; and, wherein the convex surface opening is located next to and closely adjacent the hole closest the blade leading edge whereby cooling fluid from the blade interior cavity flows into the open plenum and is discharged through the opening in the convex surface without regard to the distance between the blade tip and the surrounding annular shroud.

* * * * *